US010472868B2

(12) United States Patent
Nozawa et al.

(10) Patent No.: US 10,472,868 B2
(45) Date of Patent: Nov. 12, 2019

(54) VEHICLE DOOR LATCH DEVICE

(71) Applicant: MITSUI KINZOKU ACT CORPORATION, Kanagawa (JP)

(72) Inventors: Hideaki Nozawa, Kanagawa (JP); Tomoharu Nagaoka, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 863 days.

(21) Appl. No.: 14/917,168

(22) PCT Filed: Dec. 12, 2014

(86) PCT No.: PCT/JP2014/083036
§ 371 (c)(1),
(2) Date: Mar. 7, 2016

(87) PCT Pub. No.: WO2016/067481
PCT Pub. Date: May 6, 2016

(65) Prior Publication Data

US 2016/0305167 A1 Oct. 20, 2016

(30) Foreign Application Priority Data

Oct. 29, 2014 (JP) ..... 2014-220771

(51) Int. Cl.
*E05B 77/26* (2014.01)
*E05B 81/90* (2014.01)
(Continued)

(52) U.S. Cl.
CPC ..... *E05B 81/90* (2013.01); *E05B 79/08* (2013.01); *E05B 81/16* (2013.01); *E05B 83/36* (2013.01); *E05B 77/26* (2013.01); *E05B 81/06* (2013.01)

(58) Field of Classification Search
CPC ..... E05B 81/90
See application file for complete search history.

(56) References Cited

U.S. PATENT DOCUMENTS 3,785,186 A * 1/1974 James ..... E05B 83/16 292/216
4,494,782 A * 1/1985 Lutz ..... E05B 81/25 292/96

(Continued)

FOREIGN PATENT DOCUMENTS

JP 2003-314117 A 11/2003
JP 2009-013639 A 1/2009

(Continued)

OTHER PUBLICATIONS

International Search Report and Written Opinion issued in International Application No. PCT/JP2014/083036, dated Feb. 24, 2015.

(Continued)

*Primary Examiner* — Carlos Lugo
(74) *Attorney, Agent, or Firm* — McDermott Will & Emery LLP

(57) ABSTRACT

A vehicle door latch device includes: an interlocking unit assembly including an interlocking mechanism configured to hold the door in a closed position by engaging with a striker; and an operating unit assembly including an operating mechanism configured to switch over the door between a locked state and an unlocked state. The interlocking unit assembly includes a body having a striker advancing groove. The operating unit assembly includes: a casing, in which the interlocking unit assembly is fitted, and in which the operating mechanism is installed; a lock lever configured to move the door to a locked position where the door is in the locked state and an unlocked position where the door is in the unlocked state; an emergency operating member turnably supported by the body of the interlocking unit assembly about an axis; and a slide lever slidably installed in the casing.

1 Claim, 16 Drawing Sheets

(51) Int. Cl.

| | |
|---|---|
| ***E05B 79/08*** | (2014.01) |
| ***E05B 81/16*** | (2014.01) |
| ***E05B 83/36*** | (2014.01) |
| *E05B 81/06* | (2014.01) |

(56) References Cited

U.S. PATENT DOCUMENTS

| | | | | |
|---|---|---|---|---|
| 4,900,074 | A * | 2/1990 | Kleefeldt | E05B 77/265 292/216 |
| 4,929,007 | A * | 5/1990 | Bartczak | E05B 83/36 292/216 |
| 4,948,183 | A * | 8/1990 | Yamada | E05B 81/06 292/199 |
| 5,092,638 | A * | 3/1992 | Mizuki | E05B 77/265 292/216 |
| 5,125,701 | A * | 6/1992 | Hayakawa | E05B 77/265 292/336.3 |
| 5,186,504 | A * | 2/1993 | Takaishi | E05B 85/02 292/216 |
| 6,199,923 | B1 * | 3/2001 | Rice | E05B 77/26 292/216 |
| 6,805,387 | B1 * | 10/2004 | Williams | E05B 83/16 292/216 |
| 6,843,517 | B2 * | 1/2005 | Graute | E05B 81/90 292/201 |
| 7,232,161 | B2 * | 6/2007 | Matsuda | E05B 81/06 292/100 |
| 2015/0233150 | A1 * | 8/2015 | Mittelbach | E05B 81/06 292/201 |

FOREIGN PATENT DOCUMENTS

| | | | |
|---|---|---|---|
| JP | 2011-184949 | A | 9/2011 |
| JP | 4765123 | B2 | 9/2011 |
| JP | 2012-233318 | A | 11/2012 |
| JP | 2013-002247 | A | 1/2013 |
| JP | 2013-014943 | A | 1/2013 |

OTHER PUBLICATIONS

Japanese Office Action issued in corresponding Japanese Patent Application No. 2014-220771, dated Jun. 12, 2018, with English Translation.

* cited by examiner

VEHICLE DOOR LATCH DEVICE

FIELD

The present invention relates to a vehicle door latch device.

BACKGROUND

Door latch devices for vehicles include those, each in which an interlocking unit assembly is integrated with an operating unit assembly; the interlocking unit assembly including a body fixed to a door and made of synthetic resin, a latch accommodated in the body and engageable with a vehicle body side striker, and an interlocking mechanism, such as a pawl, engageable with the latch; and the operating unit assembly including a casing fixed to a reverse side of the body and made of synthetic resin, and an operating mechanism, which is installed in the casing, and which is able to switch over the door between a locked state and an unlocked state by the interlocking mechanism being operated (see, for example, Patent Literatures 1 and 2).

Such door latch devices include those, which do not have any lock knobs and key cylinders for security reasons, and which perform door locking/unlocking switch over only by electric operations. Such a door latch device includes an emergency lock mechanism that is able to lock a door by a key operation in order to avoid the door from becoming unlockable due to an electric system failure.

CITATION LIST

Patent Literature

Patent Literature 1: Japanese Patent No. 4765123

Patent Literature 2: Japanese Patent Application Laid-open No. 2012-233318

SUMMARY

Technical Problem

Door latch devices are preferably small sized for a reason, such as weight saving of vehicles to be installed in.

The present invention has been made in view of the above, and an object thereof is to provide a vehicle door latch device that has been downsized.

Solution to Problem

To solve the above-described problem and achieve the above-described object, a vehicle door latch device according to an embodiment of the present invention includes: an interlocking unit assembly including an interlocking mechanism provided in any one of a door and a vehicle body and configured to be able to hold the door in a closed position by engaging with a striker, which is provided in any other one of the door and the vehicle body and is configured to advance thereto along with closing movement of the door; and an operating unit assembly including an operating mechanism configured to be able to switch over the door between a locked state and an unlocked state. The interlocking unit assembly includes a body having a striker advancing groove, into which the striker advances along with the closing movement of the door, the striker advancing groove formed on one side of the body. The operating unit assembly includes: a casing, in which the interlocking unit assembly is fitted, and in which the operating mechanism is installed; a lock lever installed in the casing, and configured to be able to move the door to a locked position where the door is in the locked state and an unlocked position where the door is in the unlocked state; an emergency operating member turnably supported by the body of the interlocking unit assembly about an axis, and configured to rotate in conjunction with rotation of an operating tool inserted from the striker advancing groove of the body; and a slide lever slidably installed in the casing. The slide lever is configured: to engage with the emergency operating member; to slidingly operate from a standby position to a slid position in conjunction with rotation of the emergency operating member; and to switch over the lock lever from the unlocked position to the locked position.

In the vehicle door latch device according to the embodiment of the present invention, the slide lever is configured to maintain a state of being positioned in the standby position, in response to movement of the lock lever to the locked position and the unlocked position, when the slide lever is in the standby position.

Advantageous Effects of Invention

According to the present invention, a vehicle door latch device that has been downsized is able to be realized.

DESCRIPTION OF EMBODIMENTS

Hereinafter, an embodiment of a vehicle door latch device according to the present invention will be described with reference to the drawings. The present invention is not limited by this embodiment. Further, in describing the drawings, the same signs will be appended to the same or corresponding elements, as appropriate.

Embodiment

Figure 1:
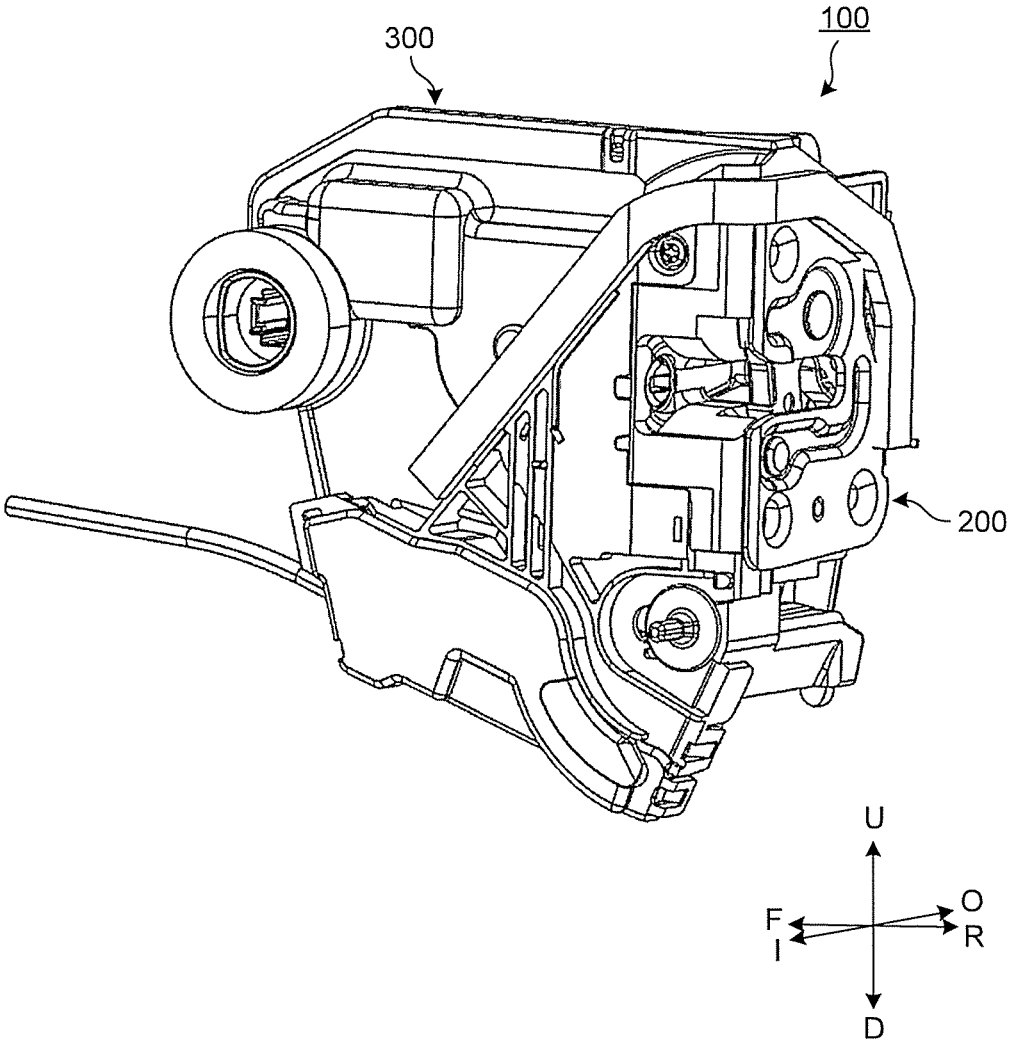
FIG. 1 is a perspective view of a vehicle door latch device according to an embodiment of the present invention.

Hereinafter, a vehicle door latch device according to this embodiment will be described, based on FIG. 1 to FIG. 16. FIG. 1 is a perspective view of the vehicle door latch device according to the embodiment of the present invention. In the following description, in a state where a door latch device 100 has been installed in a vehicle, the left in FIG. 1 will be referred to as "indoor side (I)", the right as "outdoor side (0)", the upside as "upside (U)", the downside as "downside (D)", the deeper side in the figure as "front (F)", and the shallower side in the figure as "rear (R)". These directions are defined for convenience of explanation, and of course, orientation of the door latch device 100 is modified depending on a type of the vehicle to be installed in, a position to be installed at, and the like.

The door latch device 100 according to this embodiment is to be installed in a rear end portion in a rear side door (hereinafter, abbreviated as "door") on a right side of an automobile, and is configured by installing an interlocking unit assembly 200, which has an interlocking mechanism that is able to hold a door in a closed state by engaging with a vehicle body side striker, with an operating unit assembly 300, which is for operating the interlocking unit assembly 200, to integrate the interlocking unit assembly 200 with the operating unit assembly 300.

Figure 2:
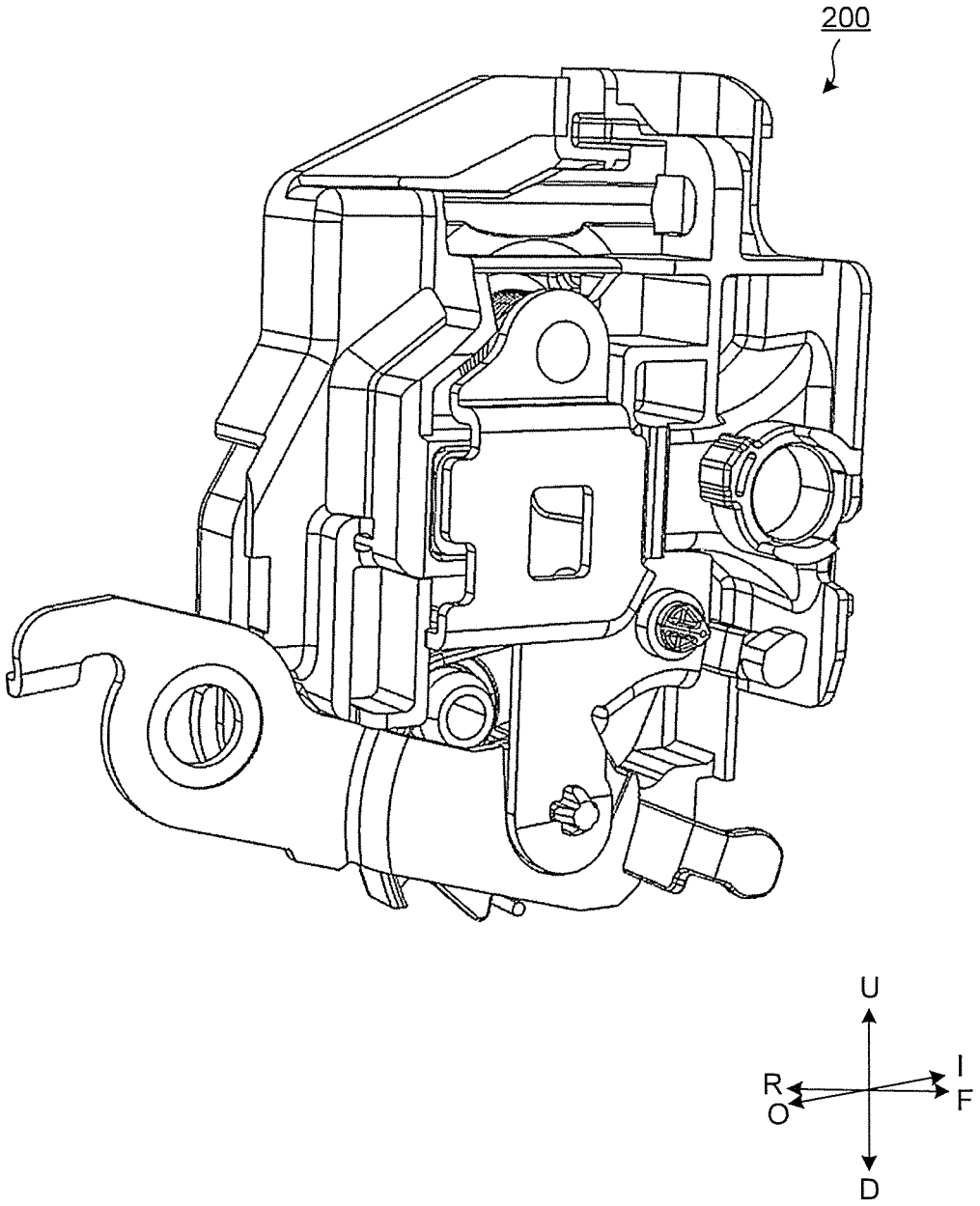
FIG. 2 is a perspective view of an interlocking unit assembly of the vehicle door latch device illustrated in FIG. 1.
Figure 3:
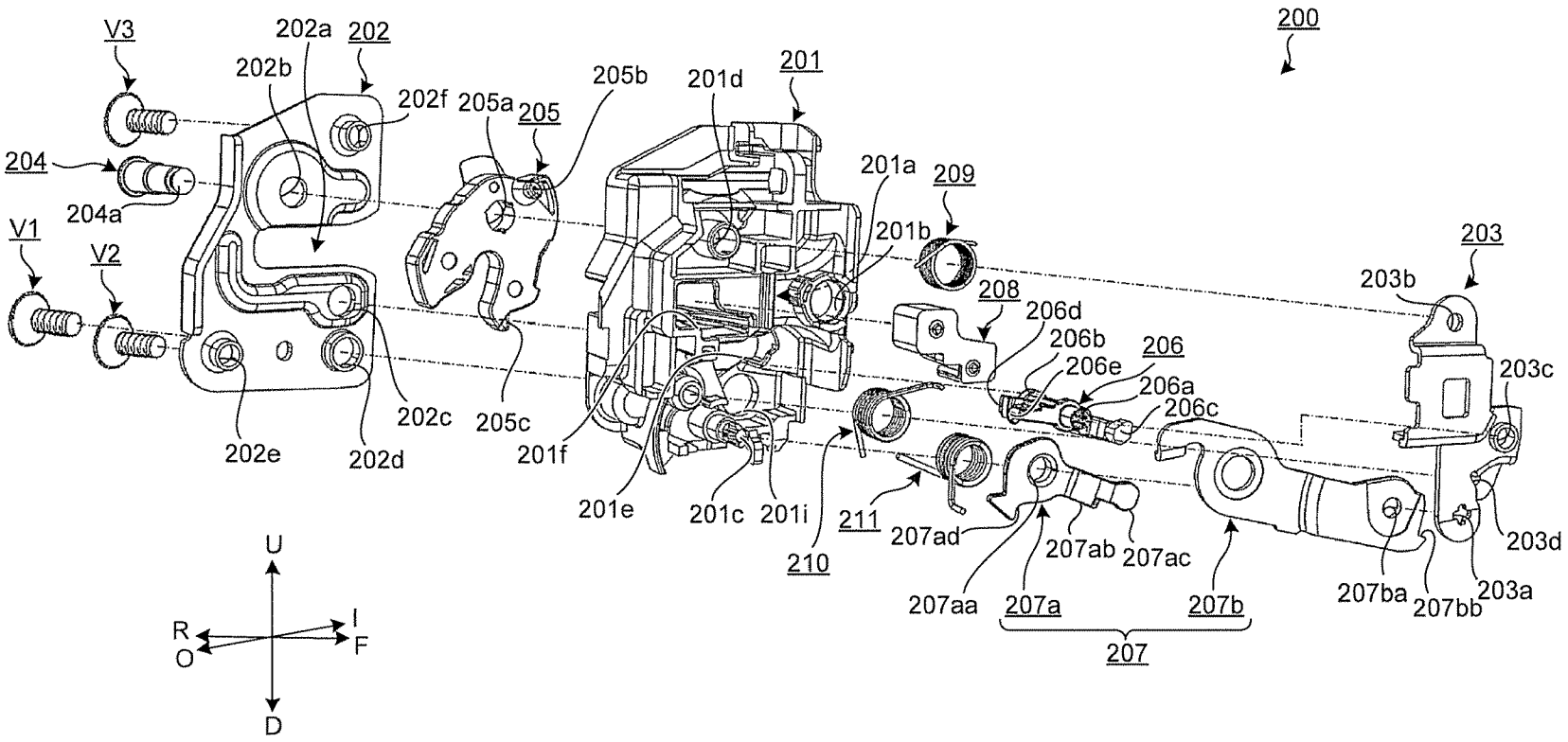
FIG. 3 is an exploded perspective view illustrating a configuration of the interlocking unit assembly illustrated in FIG. 2.

First of all, a configuration of the interlocking unit assembly 200 will be described. FIG. 2 is a perspective view of the interlocking unit assembly of the vehicle door latch device illustrated in FIG. 1. FIG. 3 is an exploded perspective view illustrating the configuration of the interlocking unit assembly illustrated in FIG. 2.

As illustrated in FIG. 3, the interlocking unit assembly 200 includes: a body 201; a cover plate 202 fixed on a rear side of the body 201; a back plate 203 fixed on a front side of the body 201; a latch shaft 204 inserted from a rear side; a latch 205 rotatably supported by the latch shaft 204; a pawl 206 that restrains the door in a closed position by engaging with the latch 205; an outside lever 207 that releases the engagement between the latch 205 and the pawl 206; and a bumper rubber 208 that abuts against the striker that has advanced thereto and the pawl 206.

Next, each part of the interlocking unit assembly 200 will be described in detail.

The body 201 is made of, for example, synthetic resin, and formed with, on one side (rear side) thereof, a striker advancing groove 201*a*, into which the striker provided in the vehicle body advances along with closing movement of the door. Further, the body 201 has an emergency lever installation hole 201*b*, which is formed to penetrate through the striker advancing groove 201*a*, and in which an emergency lever 305 described later is installed.

The cover plate 202 is made of, for example, various metals, has a notched portion 202*a*, into which the striker is able to advance, and is installed on a surface of the body 201, the surface on the rear side where the striker advancing groove 201*a* is formed.

The back plate 203 is made of, for example, various metals, and fixed by the latch shaft 204 and a bolt V1, with the cover plate 202 and the body 201 interposed therebetween. As a result, the interlocking unit assembly 200 is integrated. Further, the back plate 203 has a cross shaped hole 203*a*, into which a cross shaped projection formed at a distal end of a pivot shaft 201*c* of the body 201 is inserted.

The latch shaft 204 penetrates, from a rear side, through a shaft hole 202*b* of the cover plate 202, a shaft hole 205*a* of the latch 205, and a shaft hole 201*d* of the body 201 in this order, and a small diameter shaft portion 204*a* at a distal end portion thereof is press fitted to be substantially unrotatable into a shaft hole 203*b* of the back plate 203.

The latch 205 is pivotally supported by the latch shaft 204, accommodated in the rear side interior of the body 201, interlocks with the striker that has advanced thereto, and rotates about an axis of the latch shaft 204 from an open position via a half closed door position to a latched position. Further, the latch 205 has an engagement portion 205*b* protruding to a front side.

Figure 4:
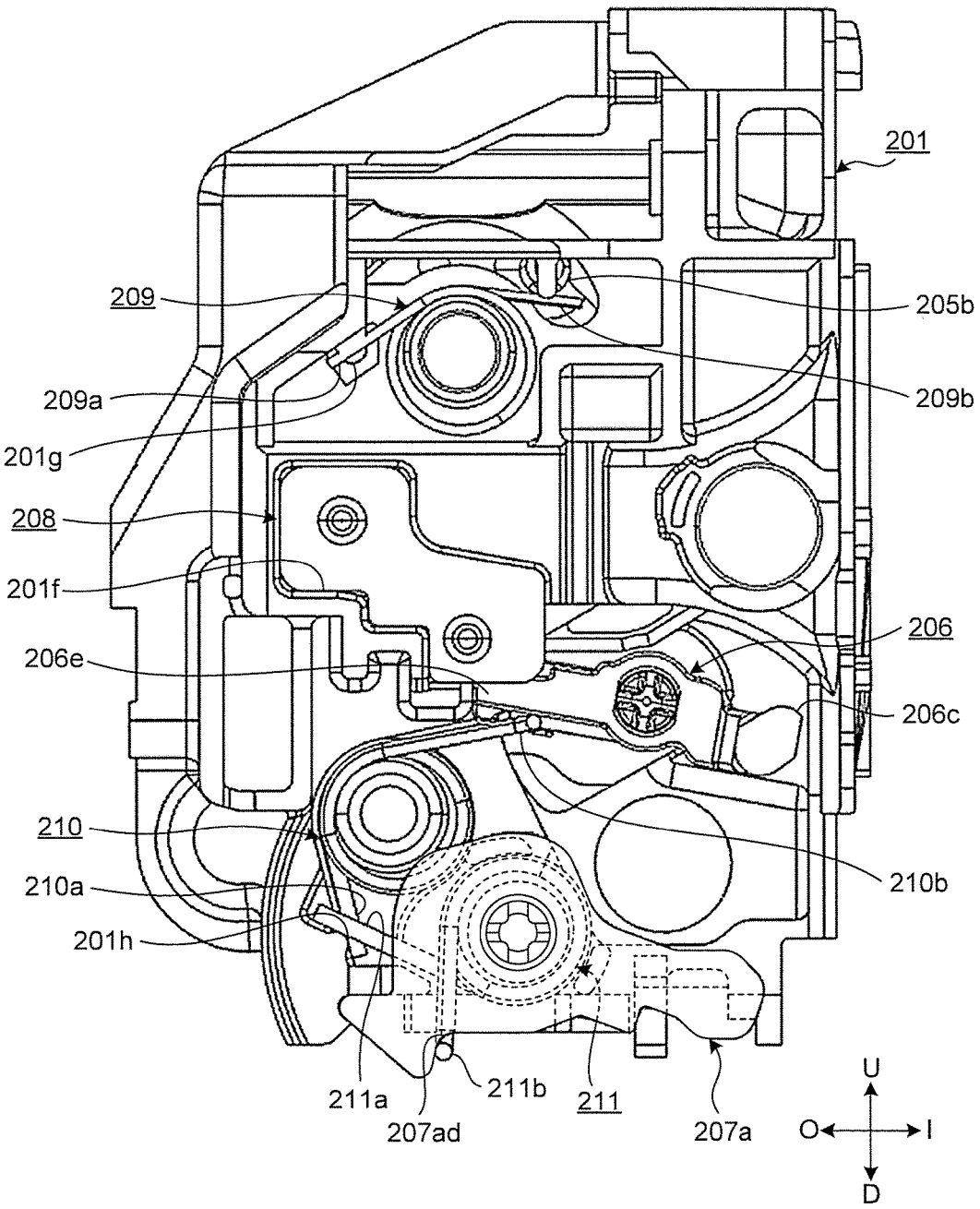
FIG. 4 is a front view illustrating an internal configuration of the interlocking unit assembly illustrated in FIG. 2.

FIG. 4 is a front view illustrating an internal configuration of the interlocking unit assembly illustrated in FIG. 2. FIG. 4 illustrates the latch 205 in the latched position. As illustrated in FIG. 4, the latch 205 is biased to rotate from the latched position to the open position (in an anticlockwise direction in FIG. 4) by the engagement portion 205*b* thereof engaging with a spring 209.

Returning to FIG. 3, the pawl 206 is installed in a pawl installation hole 201*e* formed in the body 201. Further, the pawl 206 is pivotally supported to be turnable, with a shaft portion 206*a* at a front portion thereof being inserted through a shaft hole 203*c* of the back plate 203 and a shaft portion 206*b* at a rear portion thereof being inserted through a shaft hole 202*c* of the cover plate 202.

Next, FIG. 4 illustrates the pawl 206 in an engaged position. The pawl 206 is biased by a spring 210, to rotate from a released position where the engagement thereof with the latch 205 is released, in a direction towards the engaged position where the pawl 206 is engageable with the latch 205 in the latched position. That is, the pawl 206 is biased in a clockwise direction in FIG. 4.

Further, the pawl 206 has a release lever 206*c* that releases the engagement with the latch 205, by the pawl 206 being abutted against and rotated by a later described release member 302 of the operating unit assembly 300, from the engaged position to the released position, based on an opening operation of a handle provided in the door.

Figure 5:
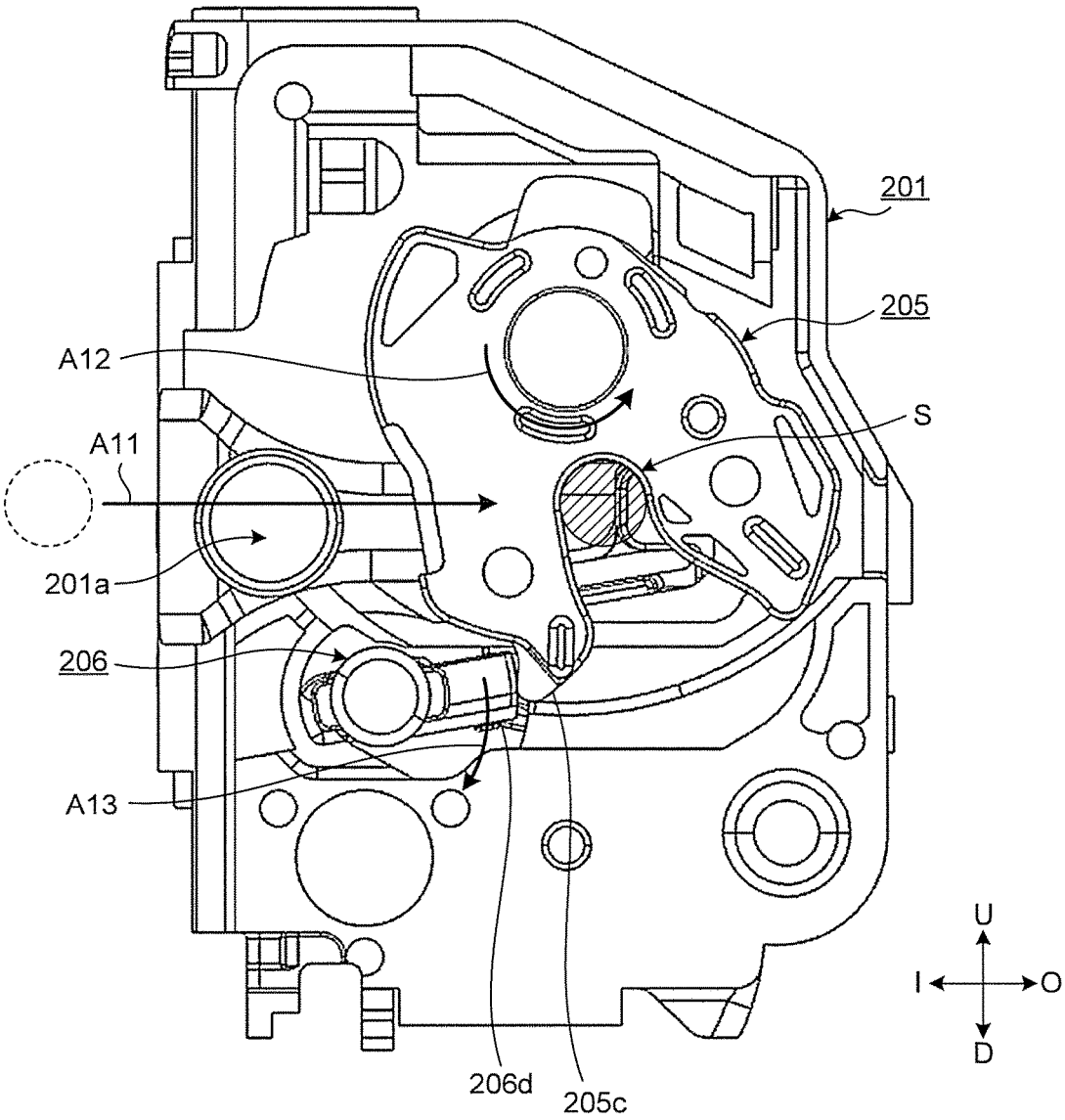
FIG. 5 is a rear view illustrating the internal configuration of the interlocking unit assembly illustrated in FIG. 2.

FIG. 5 is a rear view illustrating the internal configuration of the interlocking unit assembly illustrated in FIG. 2. FIG. 5 illustrates the pawl 206 in the engaged position. The pawl 206 is biased in an anticlockwise direction. As a result, the pawl 206 rotates from the engaged position to the released position in conjunction with rotation of the latch 205, rotates from the released position to the engaged position by the biasing force, and engages with the latch 205, to thereby restrain the door in the closed position. Further, the pawl 206 has an engagement portion 206*d*, which is engageable with the latch 205 that has interlocked with the striker S.

Returning to FIG. 3, the outside lever 207 has a two-division structure formed of: a first lever 207*a* having a shaft hole 207*aa*, through which the pivot shaft 201*c* of the body 201 is inserted; and a second lever 207*b* overlapping a front side of this first lever 207*a* and having a shaft hole 207*ba*, through which the pivot shaft 201*c* of the body 201 is inserted. Each of the first lever 207*a* and the second lever 207*b* is rotatably supported by the pivot shaft 201*c*, by the pivot shaft 201*c* being inserted into the cross shaped hole 203*a* of the back plate 203, the pivot shaft 201*c* integrally formed forward with the body 201 to be parallel with the latch shaft 204.

The first lever 207*a* is, as illustrated in FIG. 4, biased, by a spring 211, to rotate from a released position to a standby position (in the clockwise direction in FIG. 4).

Figure 6:
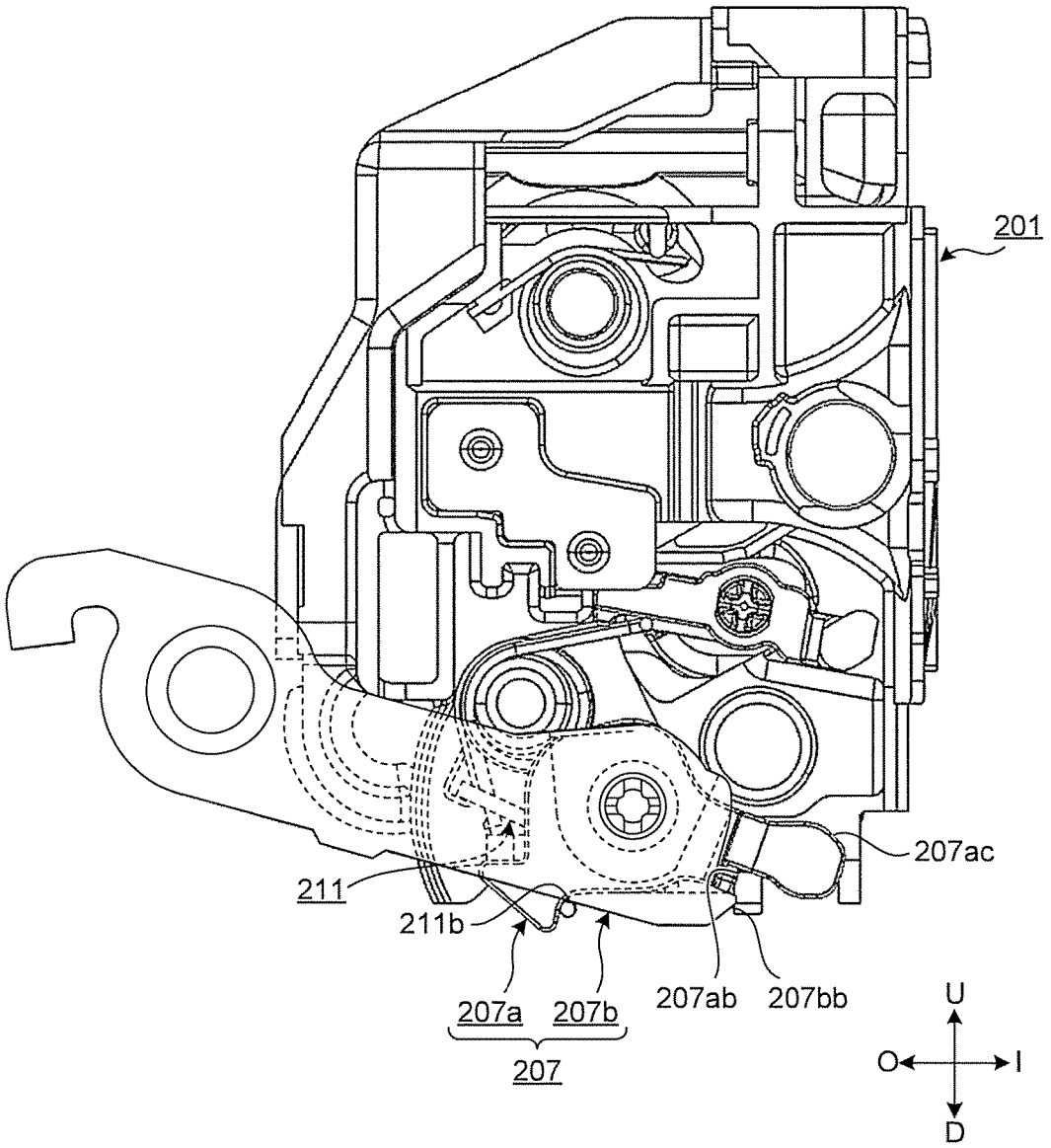
FIG. 6 is a front view illustrating a positional relation between a first lever and a second lever of the interlocking unit assembly illustrated in FIG. 2.

FIG. 6 is a front view illustrating a positional relation between the first lever and the second lever, of the interlocking unit assembly illustrated in FIG. 2. As illustrated in FIG. 6, the second lever 207*b* is biased, by the spring 211, so as to rotate from a released position to a standby position (in a clockwise direction in FIG. 6).

The first lever 207*a* and the second lever 207*b* integrally move in conjunction with each other from the standby position illustrated in FIG. 6 to the released position (in the clockwise direction in FIG. 6) by abutment of an engagement portion 207*bb* of the second lever 207*b* against a lower surface of an engagement portion 207*ab* of the first lever 207*a*, the engagement portion 207*bb* protruding to the indoor side and being claw shaped, and the engagement portion 207*ab* extending in a front-rear direction.

An end portion of the second lever 207*b*, the end portion on the outdoor side, is coupled to an outside handle (illustration thereof omitted) provided in an outer panel of the door via an operation force transmission part (illustration thereof omitted), such as a rod. When an opening operation is performed on the outside handle, via the later described release member 302 of the operating unit assembly 300 coupled to an end portion 207*ac* of the first lever 207*a*, the end portion 207*ac* on the indoor side, input based on the opening operation is placed on the release lever 206*c* of the pawl 206 and the door is able to be opened.

That is, by rotating from the released position to the standby position based on the opening operation on the outside handle, which is provided on the door and is for opening the door from outside of the vehicle body, the outside lever 207 is able to rotate the pawl 206 moving in conjunction therewith from the released position to the engaged position and to release the engagement between the latch 205 and the pawl 206.

Returning to FIG. 4, the bumper rubber 208 is made of an elastic part, such as rubber, is installed in a bumper rubber installation hole 201*f* formed in the body 201, and absorbs impact by a striker S that has advanced thereto.

The spring 209 biases the latch 205, with one end portion 209*a* thereof being hooked on a hooked portion 201*g* of the body 201, the hooked portion 201*g* at a front side, which is a shallower side of the plane of the paper, and the other end portion 209*b* thereof being hooked on the engagement portion 205*b* of the latch 205, respectively.

The spring 210 biases the pawl 206, with one end portion 210*a* thereof being hooked on a hooked portion 201*h* of the body 201 and the other end portion 210*b* thereof being hooked on an engagement portion 206*e* of the pawl 206, respectively.

The spring 211 biases the first lever 207*a* and the second lever 207*b*, with one end portion 211*a* thereof being hooked on the hooked portion 201*h* of the body 201 and the other end portion 211*b* thereof being hooked on an engagement portion 207*ad* of the first lever 207*a*, respectively.

Returning to FIG. 3, the bolt V1 penetrates through an installation hole (illustration thereof omitted) of an inner panel of the door, a through hole 202*d* of the cover plate 202, and a through hole 201*i* of the body 201 in this order, and is screwed into a screw hole 203*d* of the back plate 203.

A bolt V2 and a bolt V3 penetrate through installation holes (illustration thereof omitted) of the inner panel of the door and are screwed into a screw hole 202*e* and a screw hole 202*f* of the cover plate 202, respectively. The interlocking unit assembly 200 is fixed, together with the operating unit assembly 300, to the inner panel of the door, by these bolt V1 to bolt V3. Upon the fixing, by the bolt V1 being screwed into the screw hole 203*d* of the back plate 203 also, the back plate 203 is fixed to a reverse side of the body 201.

Next, operation of the interlocking unit assembly 200 will be described.

First, operation of the interlocking unit assembly 200 when the door is brought from an open state to the closed state will be described. When a door closing operation is performed, and as illustrated with an arrow A11 in FIG. 5, the striker S advances into the striker advancing groove 201*a* of the body 201, the latch 205 rotates, as illustrated with an arrow A12, from the open position to the latched position illustrated in FIG. 5 via the half closed door position. Further, the engagement portion 206*d* of the pawl 206 is pushed down by abutting against the latch 205, and the pawl 206 rotates in a direction of an arrow A13. Thereafter, the pawl 206 rotates in a direction biased by the spring 210 (in the anticlockwise direction in FIG. 5) and an engagement portion 205*c* of the latch 205 engages with the engagement portion 206*d* of the pawl 206. This state, where the striker S and the latch 205 are interlocked with each other, and the engagement portion 205*c* of the latch 205 and the engagement portion 206*d* of the pawl 206 are engaged with each other, is the closed state of the door.

Next, operation of the interlocking unit assembly 200 when the door is brought from the closed state to the open state will be described. When, in the closed state of the door, input based on an opening operation of the handle is placed on the release lever 206*c* of the pawl 206, the pawl 206 rotates from the engaged position to the released position as illustrated with the arrow A13 in FIG. 5, and the engagement between the engagement portion 205*c* of the latch 205 and the engagement portion 206*d* of the pawl 206 is released. The latch 205 is then rotated from the latched position to the open position by the biasing force, and the interlock between the striker S and the latch 205 is released. When the door is further operated to be opened in an outdoor direction from this state, the door is brought into the open state. When the input based on the opening operation of the handle is released, the pawl 206 rotates and returns from the released position to the engaged position by the biasing force of the spring 210.

Next, a configuration of the operating unit assembly 300 will be described. The operating unit assembly 300 has a function of: in an unlocked state, by an opening operation on the outside handle on the outdoor side of the door or on an inside handle on the indoor side of the door, releasing the engagement between the latch 205 of the interlocking unit assembly 200 and the striker to make the door openable; and in a locked state, even if an opening operation is performed on the outside handle or inside handle, making the door unopenable.

Figure 7:
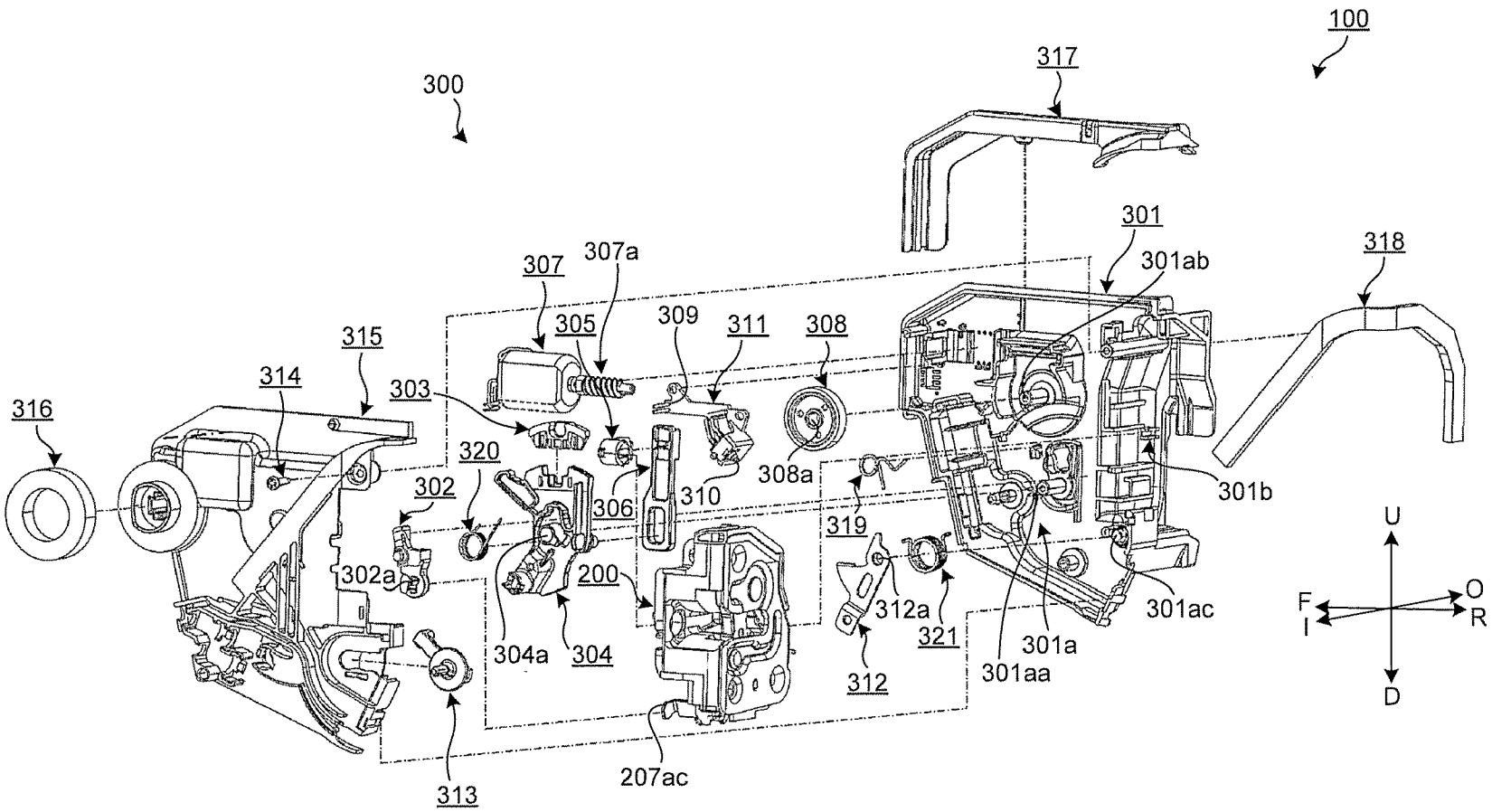
FIG. 7 is an exploded perspective view illustrating a configuration of an operating unit assembly of the vehicle door latch device illustrated in FIG. 1.

FIG. 7 is an exploded perspective view illustrating the configuration of the operating unit assembly of the vehicle door latch device illustrated in FIG. 1. As illustrated in FIG.

7, the operating unit assembly 300 is installed, together with the interlocking unit assembly 200, in a casing 301 that is substantially L-shaped in a plan view.

The operating unit assembly 300 includes: the release member 302, which engages with the above described first lever 207*a* of the outside lever 207; a lock lever 304, which engages with the release member 302, is fitted with a cam silencer 303, and is movable to a locked position and an unlocked position; the emergency lever 305, as an emergency operating member for bringing the door in the locked state upon a power system failure; a slide lever 306, which engages with the emergency lever 305 and slidingly operates; a motor 307 for locking and unlocking operation; a worm wheel 308, which meshes with a worm 307*a* fixed to a rotational axis of the motor 307 and with the cam silencer 303, and is able to switch over the lock lever 304 between the locked position and the unlocked position; a coupler 309; a switch plate 311, which is integrally installed in the casing 301 such that a lock/unlock detection switch 310, which performs detection of position of the lock lever 304, is coupled thereto; an inside lever 312, which makes the door openable by an opening operation of the inside handle; and a childproof lever 313 for childproof locking.

The interlocking unit assembly 200 and the operating unit assembly 300 are accommodated in a case formed of: the casing 301; a cover member 315, which covers an opening of the casing 301, the opening on the indoor side, is fixed to the casing 301 with a screw 314, and is made of synthetic resin; a coupler cushion 316, which is fitted to the cover member 315 from an outdoor direction, and protects an outer periphery of the coupler 309; a waterproof cover 317, which is fitted from above, is for preventing rainwater or the like from entering the case, and is made of synthetic resin; and a water proof seal 318, which is attached to a side surface of the cover member 315, the side surface on the indoor side, and prevents rainwater or the like from getting into the indoor side.

Next, each member of the operating unit assembly 300 will be described in detail.

The casing 301 is made of, for example, synthetic resin, is fitted with the interlocking unit assembly 200, and installed with an operating mechanism of the operating unit assembly 300. The casing 301 includes: an operating unit assembly accommodating portion 301*a* with an indoor side thereof being open; and an interlocking unit assembly accommodating portion 301*b*, which extends out substantially perpendicularly from a rear end of this operating unit assembly accommodating portion 301*a* in an outdoor direction, and is continuous with the operating unit assembly accommodating portion 301*a*.

The release member 302 moves in conjunction with the outside lever 207, with the end portion 207*ac* of the first lever 207*a* of the outside lever 207 being coupled to a coupling portion 302*a* thereof, the end portion 207*ac* on the indoor side. Further, the release member 302 abuts against and moves in conjunction with the inside lever 312 that rotates by an opening operation of the inside handle in the unlocked state.

A groove formed at an upper center of the cam silencer 303 engages with an engagement portion (illustration thereof omitted) formed on the outdoor side of the worm wheel 308.

The lock lever 304 is installed in the operating unit assembly accommodating portion 301*a* by a shaft tube 304*a* being fitted, from the indoor side, to a support shaft 301*aa*, the shaft tube 304*a* oriented in an indoor-outdoor direction, and the support shaft 301*aa* projecting from a side surface of the operating unit assembly accommodating portion 301*a* and facing the indoor side. The lock lever 304 is respectively biased by a turnover spring 319 towards the locked position when the lock lever 304 is in the locked position and towards the unlocked position when the lock lever 304 is in the unlocked position.

Moreover, the shaft tube 304*a* of the lock lever 304 is inserted in a spring 320 and the release member 302 is installed thereon from above. As a result, the release member 302 is biased by the spring 320 in a direction (downwards in FIG. 7) in which the engagement with the pawl 206 is released.

Further, the lock lever 304 is switched over, by operation of the slide lever 306 and the motor 307, between the locked position where the release member 302 is not engaged with the pawl 206 and the unlocked position where the release member 302 is engaged with the pawl 206.

Figure 8:
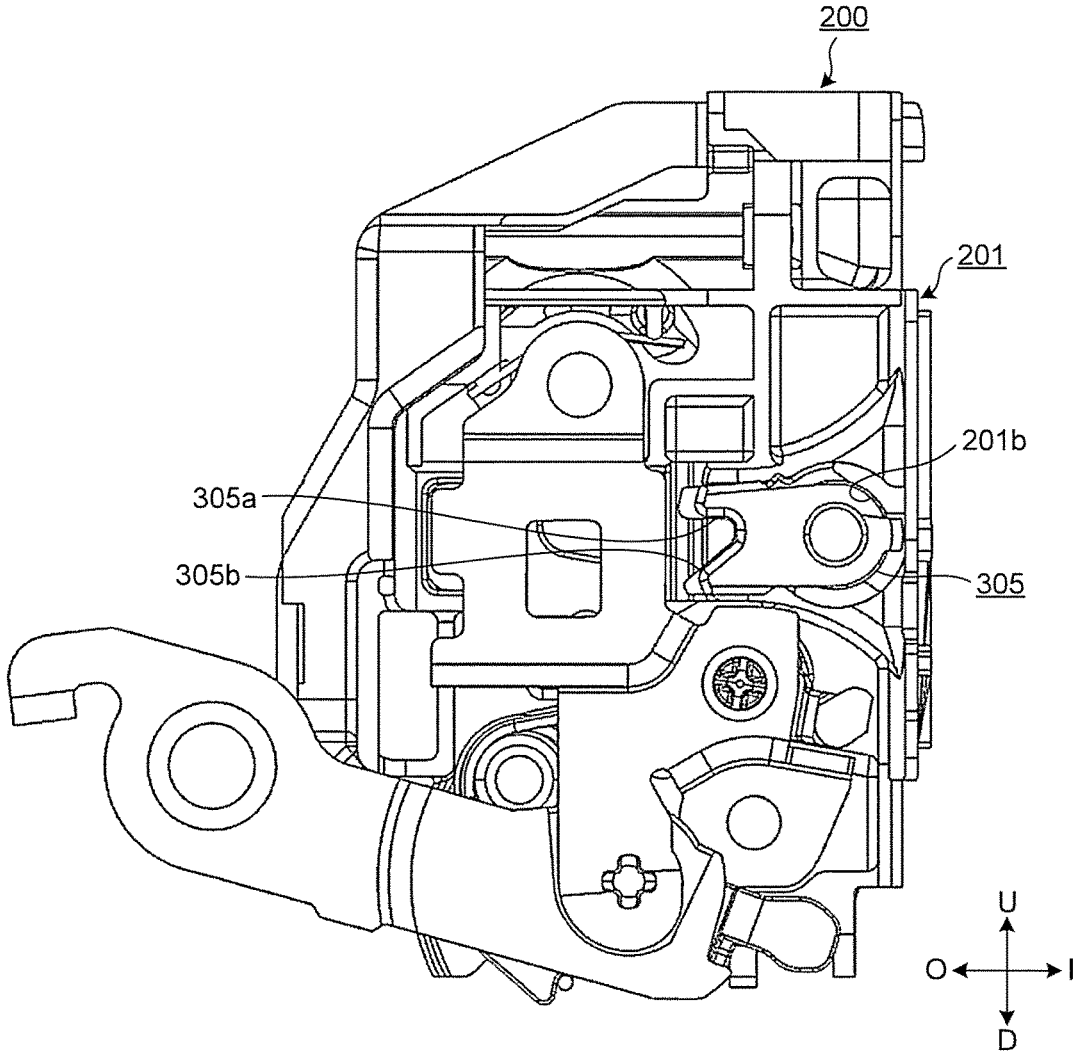
FIG. 8 is a front view illustrating how an emergency lever is installed to a body of the interlocking unit assembly.

FIG. 8 is a front view illustrating how an emergency lever is installed to the body of the interlocking unit assembly. As illustrated in FIG. 8, the emergency lever 305 is turnably supported about an axis by the emergency lever installation hole 201*b* formed in the body 201 of the interlocking unit assembly 200. Further, the emergency lever 305 has an engagement portion 305*a* and an engagement portion 305*b* for engaging with the slide lever 306.

Figure 9:
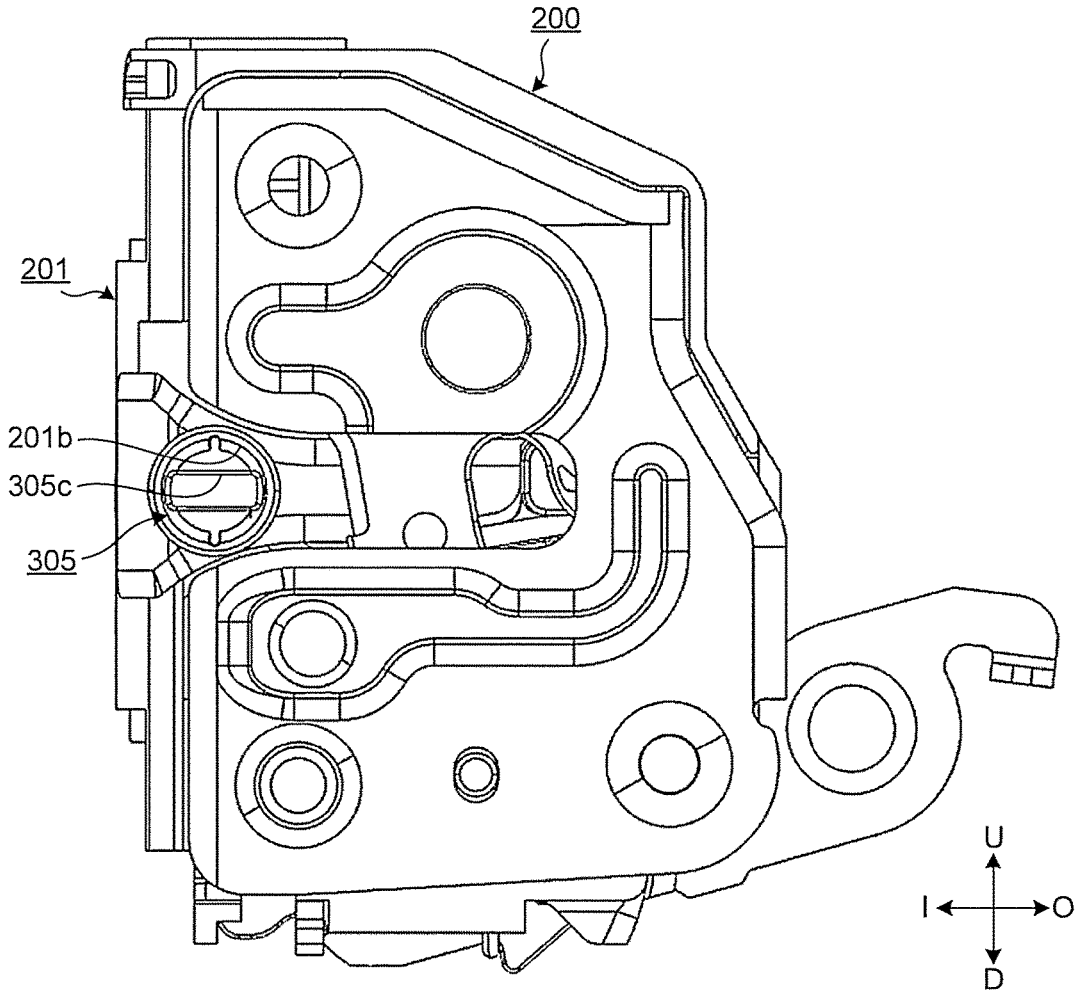
FIG. 9 is a rear view illustrating how the emergency lever is installed to the body of the interlocking unit assembly.

FIG. 9 is a rear view illustrating how the emergency lever is installed to the body of the interlocking unit assembly. As illustrated in FIG. 9, the emergency lever 305 has a fitting groove 305*c*, into which an operation tool inserted from the striker advancing groove 201*a* of the body 201 is fitted. The operating tool may be, for example, a key of the vehicle in which the door latch device 100 has been arranged, but limitation is not made thereto. The emergency lever 305 rotates in conjunction with rotation of the operation tool fitted in the fitting groove 305*c* and brings the door into the locked state.

The slide lever 306 is installed in the operating unit assembly accommodating portion 301*a* from the indoor side. The slide lever 306 slidingly operates in an up-down direction in conjunction with rotation of the emergency lever 305, and switches over the lock lever 304 to the locked position.

The motor 307 is installed in the operating unit assembly accommodating portion 301*a* from the indoor side. The motor 307 switches over the lock lever 304 between the locked position and the unlocked position by the worm 307*a* fixed to the rotational axis interlocking with the worm wheel 308 and normally and reversely rotating.

The worm wheel 308 is installed in the operating unit assembly accommodating portion 301*a* from the indoor side by a shaft hole 308*a* at a center thereof being fitted to a support shaft 301*ab*, which projects from a central portion of the operating unit assembly accommodating portion 301*a* and faces the indoor side. Teeth formed on an outer periphery of the worm wheel 308 mesh with the worm 307*a* of the motor 307 and the engagement portion thereof formed on the outdoor side engages with the cam silencer 303. As a result, the worm wheel 308 switches over the lock lever 304 between the locked position and the unlocked position by the rotation of the motor 307.

The inside lever 312 is installed in the operating unit assembly accommodating portion 301*a* from the indoor side by a shaft hole 312*a* in an upper end portion thereof being fitted to a support shaft 301*ac*, which protrudes from a side surface at a rear end portion of the operating unit assembly accommodating portion 301*a*, faces the indoor side, and is inserted through a spring 321. The inside lever 312 is biased by the spring 321 so as to rotate in a direction of returning an opening operation by the inside handle to a standby state (in an anticlockwise direction in FIG. 7). In the unlocked state, the inside lever 312 makes the door openable by an opening operation of the inside handle.

The childproof lever 313 does not abut against the inside lever 312 when the childproof lock is in a locked state, abuts against the inside lever 312, rotates, and inputs door opening operation on the release member 302 when the childproof lock is in an unlocked state.

Next, operation of the operating unit assembly 300 will be described.

Figure 10:
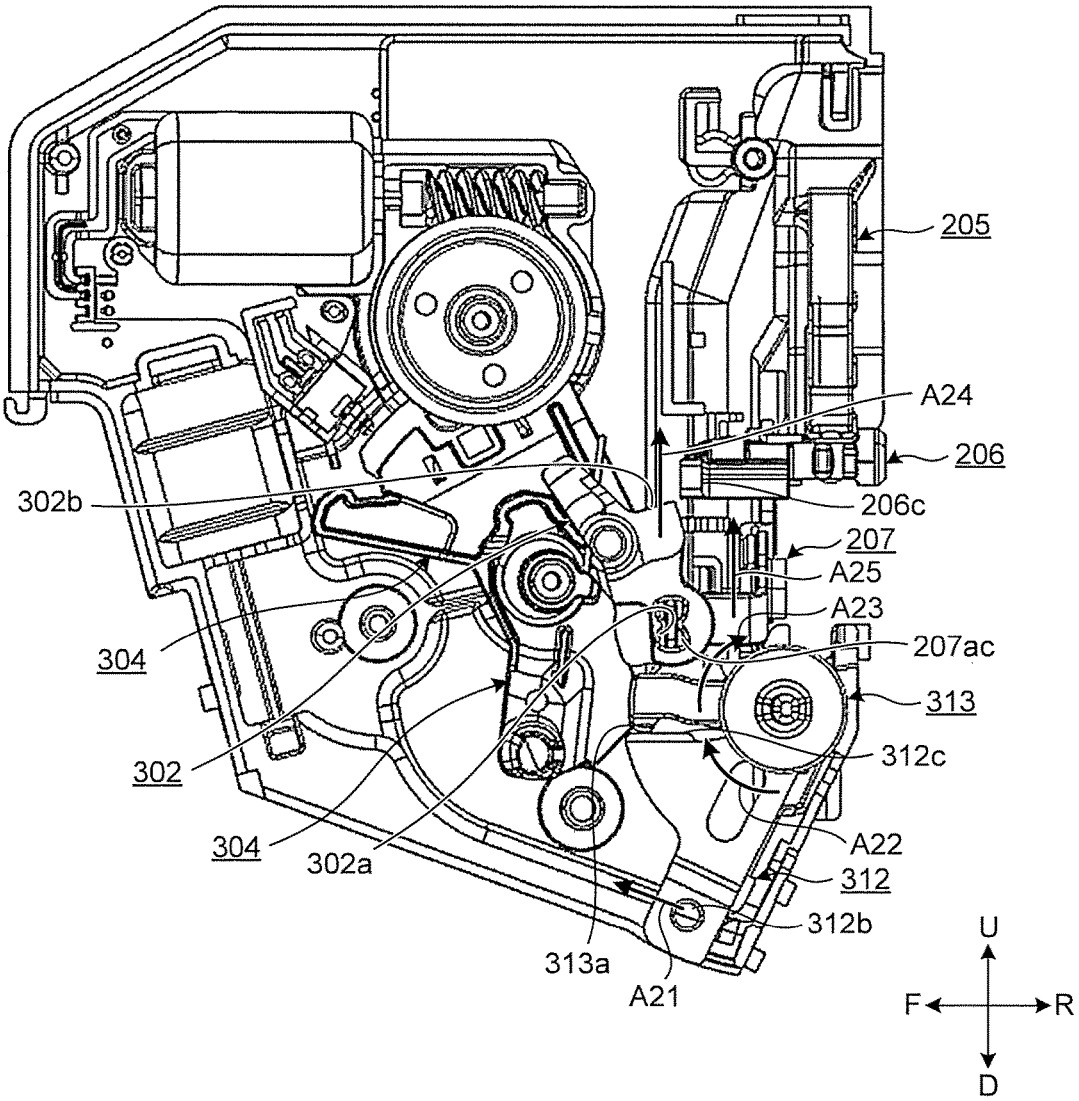
FIG. 10 is a diagram for explaining operation of the operating unit assembly illustrated in FIG. 7 in a locked state.

First, a case where the door is in the locked state, that is, a case where the lock lever 304 is in the locked position, will be described. FIG. 10 is a diagram for explaining operation of the operating unit assembly illustrated in FIG. 7 in the locked state. FIG. 10 is a diagram of the door latch device 100 as viewed from the indoor side, which is a shallower side of the plane of paper.

First, as illustrated in FIG. 10, when a door opening operation is performed on the inside handle, an engagement portion 312*b* of the inside lever 312 is pulled in a direction of an arrow A21. The inside lever 312 then rotates as illustrated with an arrow A22. When that happens, an engagement portion 312*c* of the inside lever 312 and an engagement portion 313*a* of the childproof lever 313 abut against each other, and the childproof lever 313 rotates about an axis as illustrated with an arrow A23. Further, the engagement portion 313*a* of the childproof lever 313 and a lower end portion of the release member 302 abut against each other, and the release member 302 moves upwards as illustrated with an arrow A24. When that happens, in the locked state, since an engagement portion 302*b* of the release member 302 and the release lever 206*c* of the pawl 206 do not abut against and do not hit each other, the closed state of the door is maintained.

Next, when a door opening operation is performed on the outside handle, the first lever 207*a* of the outside lever 207 rotates in a direction of an arrow A25 in conjunction with the second lever 207*b* of the outside lever 207. When this happens, since the end portion 207*ac* of the first lever 207*a* and the coupling portion 302*a* of the release member 302 are coupled to each other, the release member 302 moves in conjunction with the rotation of the first lever 207*a*. Even if the release member 302 moves upwards as illustrated with an arrow A24 in the locked state, the engagement portion 302*b* of the release member 302 does not abut against and does not hit the release lever 206*c* of the pawl 206, and thus the closed state of the door is maintained.

Accordingly, even if an opening operation is performed on the inside handle or the outside handle in the locked state, the operating unit assembly 300 operates such that the closed state of the door is maintained.

Figure 11:
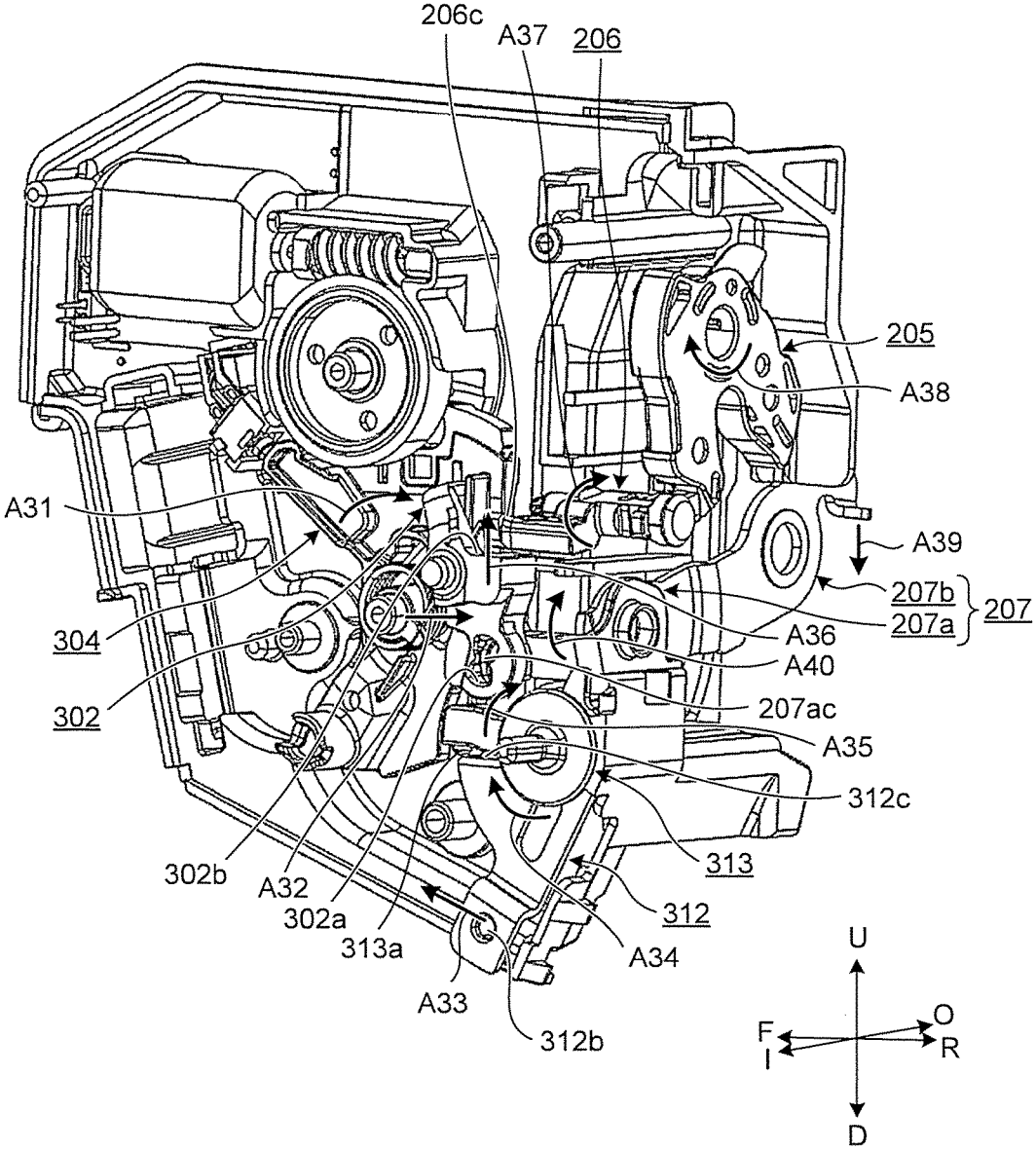
FIG. 11 is a diagram for explaining operation of the operating unit assembly illustrated in FIG. 7 in an unlocked state.

Next, a case where the door is in the unlocked state, that is, a case where the lock lever 304 is in the unlocked position will be described. FIG. 11 is a diagram for explaining operation of the operating unit assembly illustrated in FIG. 7 in the unlocked state. FIG. 11 is a perspective view of the indoor side of the door latch device 100 as viewed from the rear side.

First, in the unlocked state of the door, the lock lever 304 is positioned in the unlocked position where the lock lever 304 has rotated in a clockwise direction from the locked position as illustrated with an arrow A31. In conjunction therewith, the release member 302 is positioned on a rearer side than the locked state as illustrated with an arrow A32.

As illustrated in FIG. 11, when a door opening operation is performed on the inside handle, the engagement portion 312*b* of the inside lever 312 is pulled in a direction of an arrow A33. The inside lever 312 then rotates as illustrated with an arrow A34. When that happens, the engagement portion 312*c* of the inside lever 312 and an engagement portion 313*a* of the childproof lever 313 abut against each other, and the childproof lever 313 rotates about an axis as illustrated with an arrow A35. Further, the engagement portion 313*a* of the childproof lever 313 and a lower end portion of the release member 302 abut against each other, and the release member 302 moves upwards as illustrated with an arrow A36. In the unlocked state, since the engagement portion 302*b* of the release member 302 and the release lever 206*c* of the pawl 206 abut against each other, the pawl 206 rotates as illustrated with an arrow A37. As a result, the engagement between the pawl 206 and the latch 205 is released, the latch 205 rotates as illustrated with an arrow A38, and the interlock between the latch 205 and the striker is released. When the door is operated to be opened in the outdoor direction from this state, the door is brought into the open state.

Next, when a door opening operation is performed on the outside handle, the second lever 207*b* of the outside lever 207 is pulled in a direction of an arrow A39. In conjunction with the second lever 207*b*, the first lever 207*a* of the outside lever 207 then rotates in a direction of an arrow A40. When this happens, since the end portion 207*ac* of the first lever 207*a* and the coupling portion 302*a* of the release member 302 are coupled to each other, the release member 302 moves upwards as illustrated with the arrow A36 in conjunction with the rotation of the first lever 207*a*. Since the engagement portion 302*b* of the release member 302 then abuts against the release lever 206*c* of the pawl 206, the pawl 206 rotates as illustrated with the arrow A37. As a result, the engagement between the pawl 206 and the latch 205 is released, the latch 205 rotates as illustrated with an arrow A38, and the interlock between the latch 205 and the striker is released. When the door is operated to be opened in the outdoor direction from this state, the door is brought into the open state.

Accordingly, in the unlocked state, when an opening operation is performed on the inside handle or the outside handle, the operating unit assembly 300 operates so that the door is brought into the open state.

Figure 12:
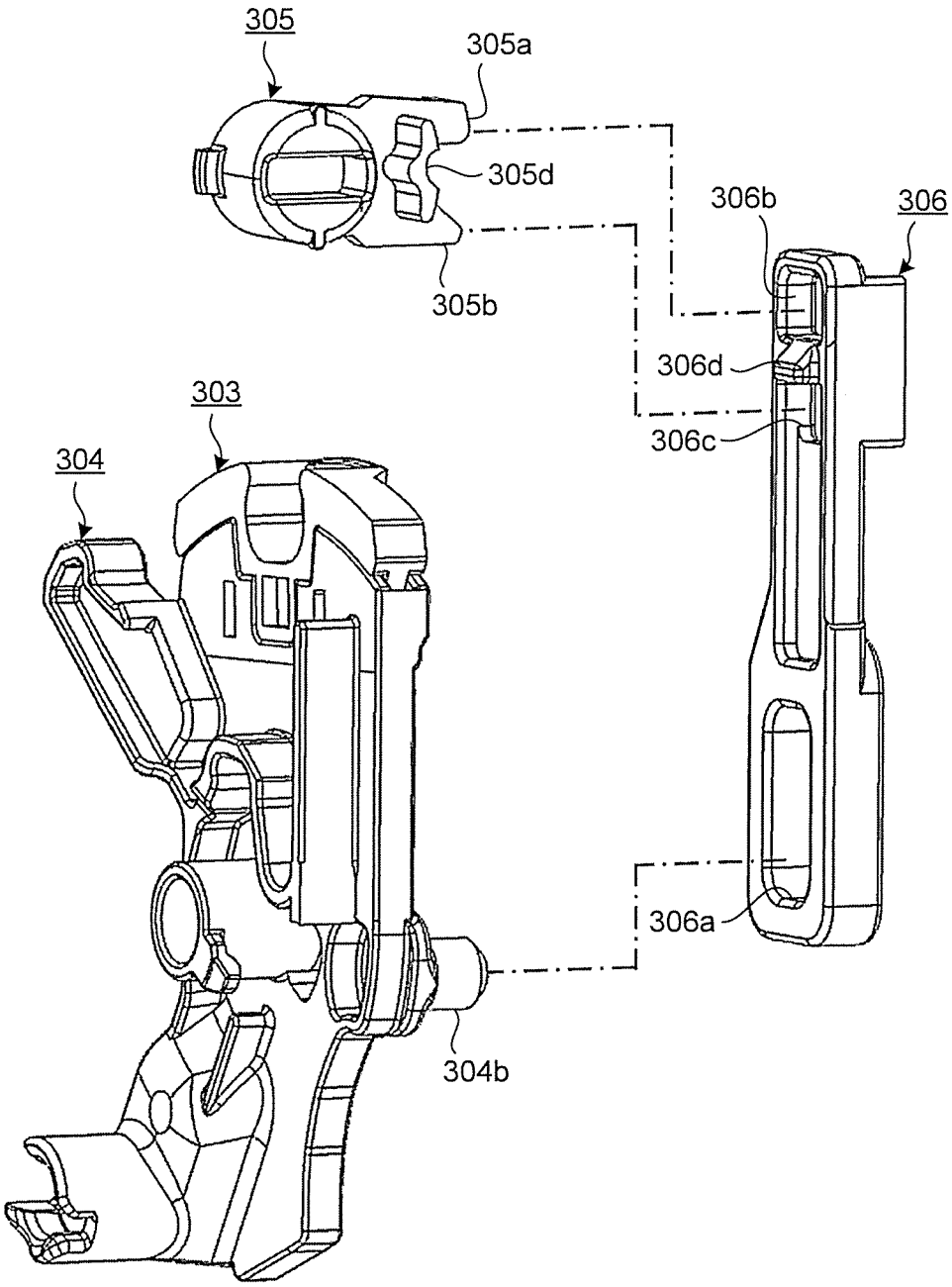
FIG. 12 is a diagram for explaining how a lock lever, the emergency lever, and a slide lever are engaged with one another.

Next, an emergency lock mechanism will be described. The emergency lock mechanism of the door latch device 100 is formed of the lock lever 304, the emergency lever 305, and the slide lever 306. FIG. 12 is a diagram for explaining how the lock lever, the emergency lever, and the slide lever are engaged with one another. As illustrated in FIG. 12, the lock lever 304 and the slide lever 306 move in conjunction with each other by an engagement portion 304*b* of the lock lever 304 engaging with a long hole 306*a* of the slide lever 306. Further, the emergency lever 305 and the slide lever 306 move in conjunction with each other by the engagement portion 305*a* of the emergency lever 305 engaging with an engagement groove 306*b* of the slide lever 306, the engagement portion 305*b* of the emergency lever 305 engaging with an engagement groove 306*c* of the slide lever 306, and a concave portion 305*d* of the emergency lever 305 engaging with a convex portion 306*d* of the slide lever 306, respectively.

Figure 13:
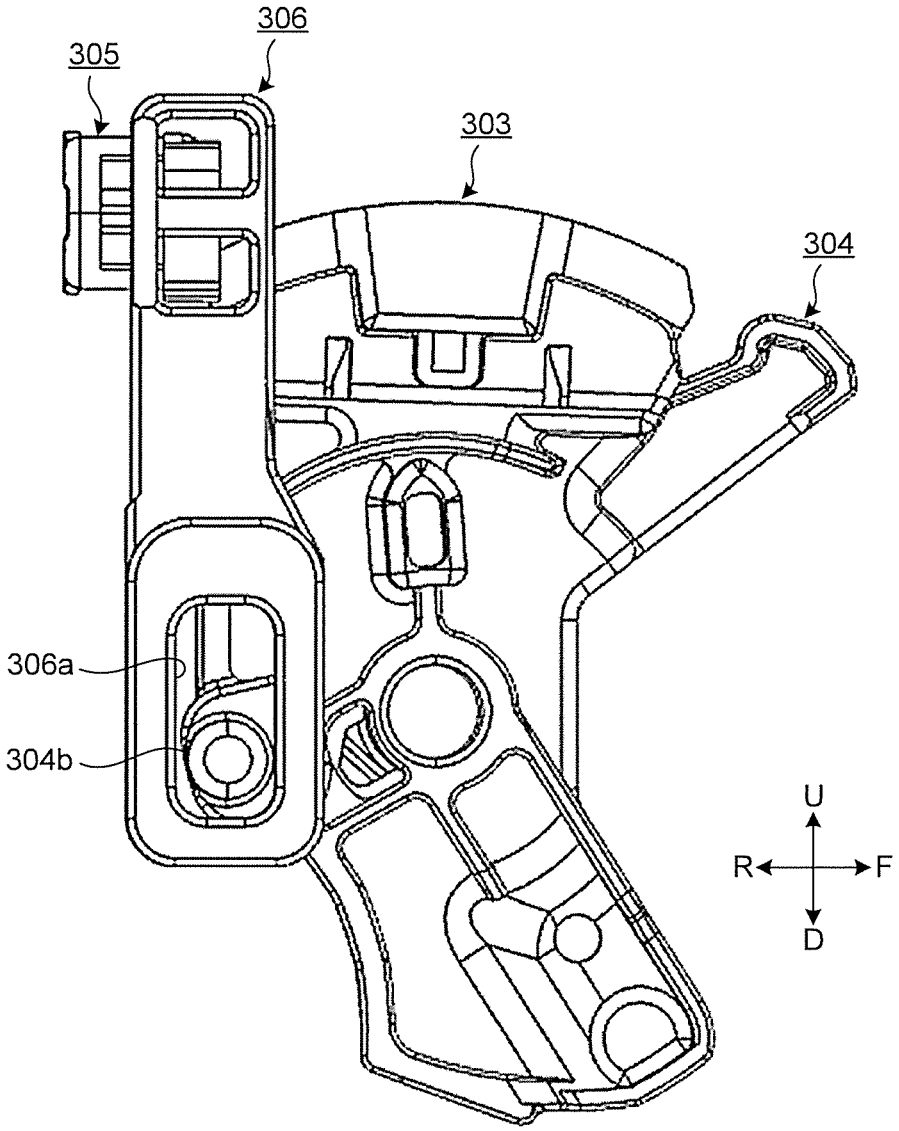
FIG. 13 is a diagram illustrating how the lock lever in an unlocked position engages with the slide lever in a standby position.

Firstly, a case where a lock operation by the operation tool is performed on the emergency lever 305 when the lock lever 304 is in the unlocked position will be described. FIG. 13 is a diagram illustrating how the lock lever in the unlocked position engages with the slide lever in the standby position. As illustrated in FIG. 13, in a state where the slide lever 306 is in the standby position before the lock operation is performed, the engagement portion 304*b* of the lock lever 304 is positioned at a lower side in the long hole 306*a* of the slide lever 306.

Figure 14:
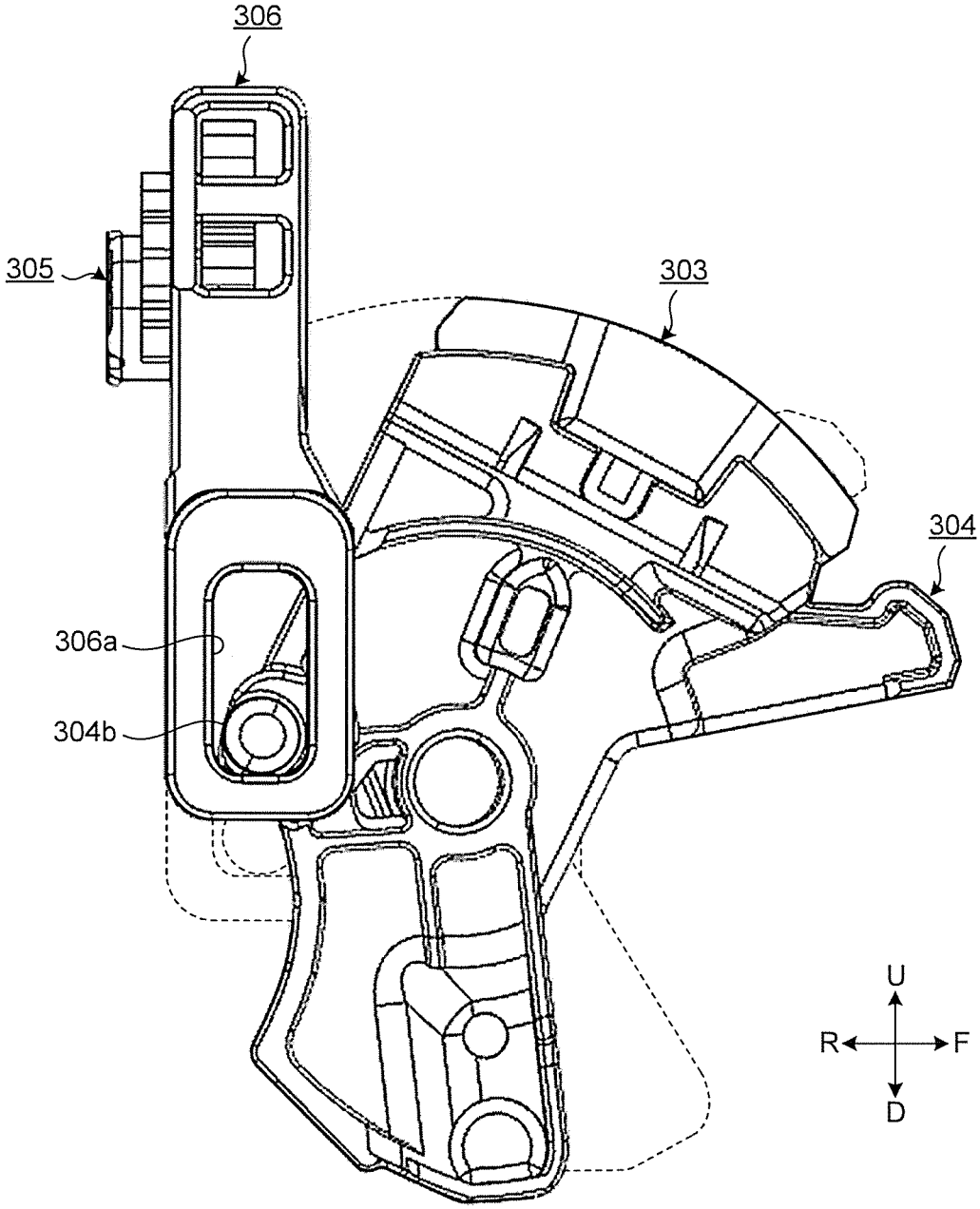
FIG. 14 is a diagram illustrating how the lock lever in a locked position engages with the slide lever in a slid position.

When the emergency lever 305 is rotated by the operation tool, the slide lever 306 moves in conjunction with the emergency lever 305 and slidingly operates from the standby position to the slid position. FIG. 14 is a diagram illustrating how the lock lever in the locked position engages with the slide lever in the slid position. As illustrated in FIG. 14, when the slide lever 306 slidingly operates, the engagement portion 304*b* of the lock lever 304 is pulled up to an upper side and the lock lever 304 is switched over from the unlocked position (broken line in FIG. 14) to the locked position (solid line in FIG. 14). That is, the emergency lock mechanism of the door latch device 100 has a function of switching over the door latch device 100 from the unlocked state to the locked state by the lock operation of the operation tool.

Figure 15:
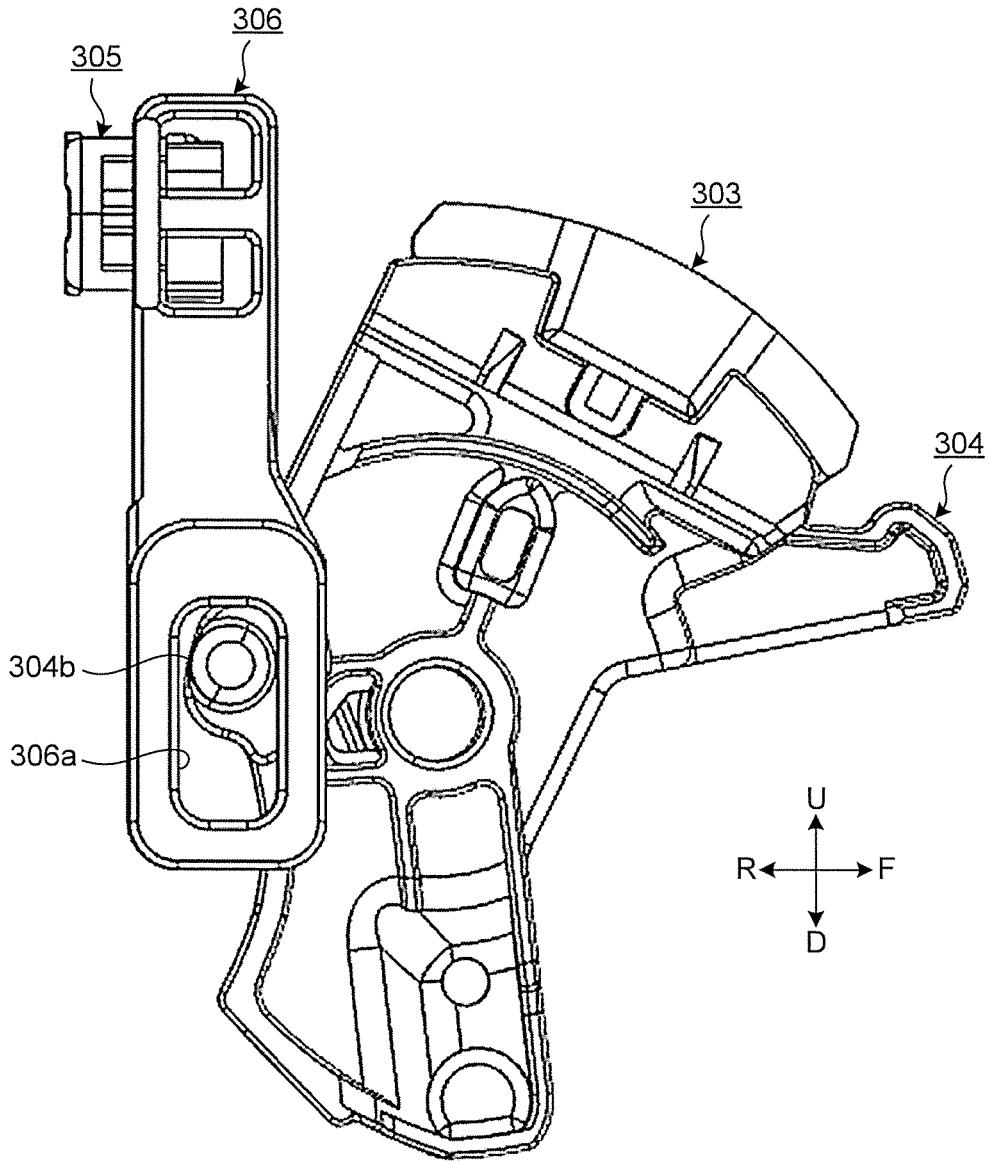
FIG. 15 is a diagram illustrating how the lock lever in the locked position engages with the slide lever in the standby position.

Next, a case where a lock operation by the operation tool is performed on the emergency lever 305 when the lock lever 304 is in the locked position will be described. FIG. 15 is a diagram illustrating how the lock lever in the locked position engages with the slide lever in the standby position. As illustrated in FIG. 15, in a state where the slide lever 306 is in the standby position before the lock operation is performed, the engagement portion 304*b* of the lock lever 304 is positioned at an upper side in the long hole 306*a* of the slide lever 306.

Figure 16:
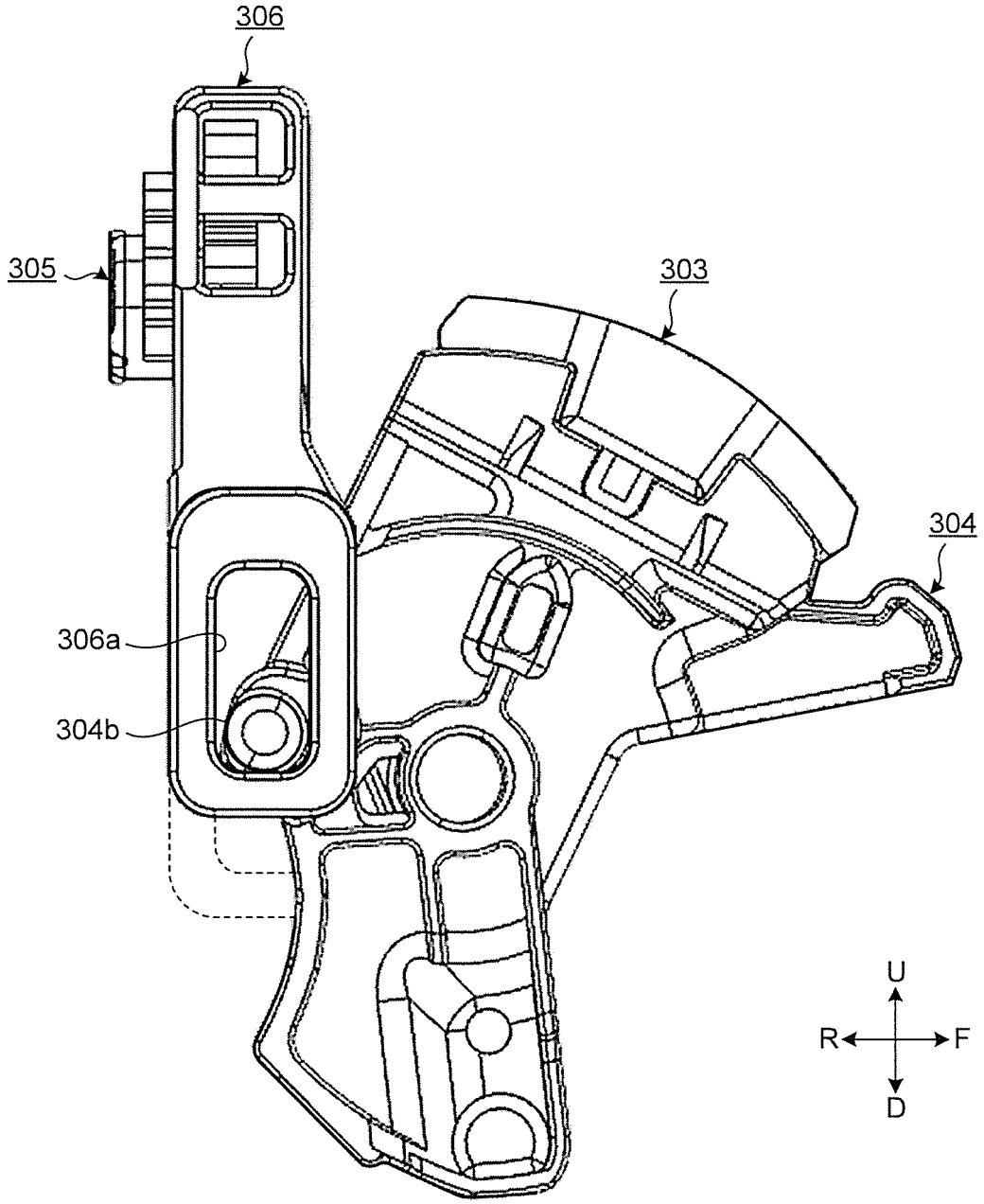
FIG. 16 is a diagram illustrating how the lock lever in the locked position engages with the slide lever in the slid position.

When the emergency lever 305 is rotated by the operation tool, the slide lever 306 moves in conjunction with the emergency lever 305 and slidingly operates from the standby position to the slid position. FIG. 16 is a diagram illustrating how the lock lever in the locked position engages with the slide lever in the slid position. As illustrated in FIG. 16, when the slide lever 306 slidingly operates from the standby position (broken line in FIG. 16) to the slid position (solid line in FIG. 16), the engagement portion 304*b* of the lock lever 304 passes in the long hole 306*a* of the slide lever 306 and the lock lever 304 maintains the state of being positioned in the locked position. That is, the emergency lock mechanism of the door latch device 100 has a function of maintaining the locked state when the door latch device 100 is in the locked state.

Further, as clear from FIG. 13 and FIG. 15, when the slide lever 306 is in the standby position, even if the lock lever 304 is moved to the locked position and to the unlocked position, the slide lever 306 maintains the state of being positioned in the standby position.

An emergency lock mechanism of a door latch device is conventionally formed of: an emergency lever that rotates by an operation of an operation tool; a rotating member that rotates in conjunction with the emergency lever; and a lock lever that moves from an unlocked position to a locked position in conjunction with the rotating member. Since a large space needs to be secured for rotating motion of the rotating member, there has been a problem that the door latch device is difficult to be downsized.

In contrast, the door latch device 100 is configured such that the slide lever 306 slidingly operates in conjunction with the emergency lever 305. A large space does not need to be secured for sliding operation of the slide lever 306, and a downsized vehicle door latch device is able to be realized.

As described above, the door latch device 100 according to this embodiment is a downsized vehicle door latch device.

Further, the emergency lock mechanism just needs to bring the door in the locked state upon an electric system failure, and does not need to operate upon normal use. Therefore, from the viewpoint of improving the durability and preventing failures, the emergency lock mechanism preferably does not operate upon normal use.

In the door latch device 100, when the slide lever 306 is in the standby position, even if the lock lever 304 is moved to the locked position and the unlocked position, the slide lever 306 maintains the state of being positioned in the standby position. Therefore, the door latch device 100 is a vehicle door latch device with improved durability and failures thereof being prevented.

According to the above description of the embodiment, the vehicle door latch device is provided on the door side and the striker is provided on the vehicle body side, but the present invention is not limited thereto. That is, the present invention is also adaptable to a case where the vehicle door latch device is provided on the vehicle body side and the striker is provided on the door side.

Further, according to the above description of the embodiment, the vehicle door latch device is installed in the rear side door of the automobile, but the vehicle door latch device of the present invention may of course be installed in a front side door thereof.

Furthermore, according to the above description of the embodiment, the vehicle door latch device is installed in the door on the right side of the automobile, but if the vehicle door latch device of the present invention is installed in a door on a left side of the automobile, the vehicle door latch device may be formed symmetrically thereto with respect to a plane along the front-rear direction of the vehicle.

Moreover, according to the above description of the embodiment, the slide lever 306 has the long hole 306*a*, but the present invention is not limited thereto. The long hole 306*a* may be, for example, a groove, and may be configured to maintain the state where the slide lever 306 is in the standby state in response to the locking/unlocking switch over of the lock lever 304 when the slide lever 306 is in the standby state.

In addition, according to the above description of the embodiment, in the lock lever 304 and the slide lever 306, the engagement portion 304*b* of the lock lever 304 is inserted in the long hole 306*a* of the slide lever 306, the engagement portion 304*b* protruding to the outdoor side, but the present invention is not limited thereto. That is, an engagement portion of the slide lever, the engagement portion protruding to the indoor side, may be configured to be inserted in a hole formed in the lock lever. Further, the long hole 306*a* of the slide lever 306 is not limited to the hole penetrating through the slide lever 306. The slide lever 306 may be configured to maintain the state of being positioned in the standby position in response to the locked position and unlocked position switch over of the lock lever 304 when the slide lever 306 is in the standby position, and for example, may be a long groove.

Similarly, according to the above description of the embodiment, in the emergency lever 305 and the slide lever 306, the engagement portion 305*a* and the engagement portion 305*b* of the emergency lever 305, the engagement portions 305*a* and 305*b* protruding to the outdoor side, are respectively inserted in the engagement groove 306*b* and the engagement groove 306*c* of the slide lever 306, but the present invention is not limited thereto. That is, an engagement portion of the slide lever, the engagement portion protruding to the indoor side, may be configured to be inserted in a hole or groove formed in the emergency lever.

Furthermore, the present invention is not limited by the above described embodiment. Those configured by combining as appropriate the respective components described above are also included in the present invention. Moreover, further effects and modifications can be easily derived by those skilled in the art. Therefore, wider aspects of the present invention are not limited to the above described embodiment and various modifications may be made.

INDUSTRIAL APPLICABILITY

As described above, a vehicle door latch device according to the present invention is useful for downsizing of vehicle door latch devices.

REFERENCE SIGNS LIST

100 DOOR LATCH DEVICE
200 INTERLOCKING UNIT ASSEMBLY
201 BODY
201*a* STRIKER ADVANCING GROOVE
201*b* EMERGENCY LEVER INSTALLATION HOLE
201*c* PIVOT SHAFT
201*d*, 202*b*, 202*c*, 203*b*, 203*c*, 205*a*, 207*aa*, 207*ba*, 308*a*, 312*a* SHAFT HOLE
201*e* pawl INSTALLATION HOLE
201*f* BUMPER RUBBER INSTALLATION HOLE
201*g*, 201*h* HOOKED PORTION
201*i*, 202*d* THROUGH HOLE
202 COVER PLATE
202*a* NOTCHED PORTION
202*e*, 202*f*, 203*d* SCREW HOLE
203 BACK PLATE
203*a* CROSS SHAPED HOLE
204 LATCH SHAFT
204*a* SMALL DIAMETER SHAFT PORTION
205 LATCH
205*b*, 205*c*, 206*d*, 206*e*, 207*ab*, 207*ad*, 207*bb*, 302*b*, 304*b*, 305*a*, 305*b*, 312*b*, 312*c*, 313*a* ENGAGEMENT PORTION
206 pawl
206*a*, 206*b* SHAFT PORTION
206*c* RELEASE LEVER
207 OUTSIDE LEVER
207*a* FIRST LEVER
207*ac*, 209*a*, 209*b*, 210*a*, 210*b*, 211*a*, 211*b* END PORTION
207*b* SECOND LEVER
208 BUMPER RUBBER
209, 210, 211, 320, 321 SPRING
300 OPERATING UNIT ASSEMBLY
301 CASING
301*a* OPERATING UNIT ASSEMBLY ACCOMMODATING PORTION
301*aa*, 301*ab*, 301*ac* SUPPORT SHAFT
301*b* INTERLOCKING UNIT ASSEMBLY ACCOMMODATING PORTION
302 RELEASE MEMBER
302*a* COUPLING PORTION
303 CAM SILENCER
304 LOCK LEVER
304*a* SHAFT TUBE
305 EMERGENCY LEVER
305*c* FITTING GROOVE
305*d* CONCAVE PORTION
306 SLIDE LEVER
306*a* LONG HOLE
306*b*, 306*c* ENGAGEMENT GROOVE
306*d* CONVEX PORTION
307 MOTOR
307*a* WORM
308 WORM WHEEL
309 COUPLER
310 LOCK/UNLOCK DETECTION SWITCH
311 SWITCH PLATE
312 INSIDE LEVER
313 CHILDPROOF LEVER
314 SCREW
315 COVER MEMBER
316 COUPLER CUSHION
317 WATERPROOF COVER
318 WATERPROOF SEAL
319 TURNOVER SPRING
V1, V2, V3 BOLT
A11, A12, A13, A21, A22, A23, A24, A25, A31, A32, A33, A34, A35, A36, A37, A38, A39, A40 ARROW
S STRIKER

The invention claimed is:

1. A vehicle door latch device comprising:

an interlocking unit assembly including an interlocking mechanism provided in any one of a door and a vehicle body and configured to hold the door in a closed position by engaging with a striker, which is provided in any other one of the door and the vehicle body and is configured to advance thereto along with closing movement of the door; and an operating unit assembly including an operating mechanism configured to switch over the door between a locked state and an unlocked state, wherein the interlocking unit assembly includes a body having a striker advancing groove, into which the striker advances along with the closing movement of the door, the striker advancing groove formed on one side of the body, and the operating unit assembly includes:

a casing, in which the interlocking unit assembly is fitted, and in which the operating mechanism is installed;

a lock lever installed in the casing, and configured to move the door to a locked position where the door is in the locked state and an unlocked position where the door is in the unlocked state;

an emergency operating member that allows the lock lever to be manually moved when a power failure that prevents power operation of the lock lever occurs, the emergency operation member being turnably supported by the body of the interlocking unit assembly about an axis, and configured to rotate in conjunction with rotation of an operating tool inserted from the striker advancing groove of the body; and a slide lever slidably installed in the casing, and configured:

to engage with the emergency operating member;

to slidingly operate from a standby position to a slid position in conjunction with rotation of the emergency operating member; and to switch over the lock lever from the unlocked position to the locked position, the emergency operating member includes two engagement portions and a concave portion, the slide lever includes two engagement grooves and a convex portion, the emergency operating member and the slide lever are configured to move in conjunction with each other by one of the engagement portions of the emergency operating member engaging with one of the engagement grooves of the slide lever, another one of the engagement portions of the emergency operating member engaging with another one of the engagement grooves of the slide lever, and the concave portion of the emergency operating member engaging with the convex portion of the slide lever, respectively, when the emergency operating member is rotated in a first direction, the slide lever slidingly operates from the standby position to the slid position to switch over the lock lever from the unlocked position to the locked position, when the emergency operating member is rotated in a second direction, the slide lever slidingly operates from the slid position to the standby position, the lock lever includes an engagement portion, the slide lever includes a long hole configured to engage with the engagement portion of the lock lever when the emergency operating member rotates, the slide lever is configured to maintain a state of being positioned in the standby position by the engagement portion of the lock lever passing in the long hole of the slide lever, in response to movement of the lock lever to the locked position and the unlocked position, when the slide lever is in the standby position, the long hole is formed along a slide direction of the slide lever, when the slide lever is in the standby position, the engagement portion of the slide lever is movable between a first end and a second end of the long hole in the slide direction to move the lock lever between the unlocked position and the locked position, when the slide lever is moved from the standby position to the slid position in conjunction with the rotation of the emergency operating member in the first direction, in a state where the lock lever is in the unlocked position, the engagement portion of the lock lever is engaged with the first end of the long hole to move the lock lever from the unlocked position to the locked position, and when the slide lever is moved from the slid position to the standby position in conjunction with the rotation of the emergency operating member in the second direction, in a state where the lock lever is in the locked position, the engagement portion of the lock lever is moved within the long hole of the slide lever to maintain the state where the lock lever is in the locked position during a slide operation of the slide lever.

* * * * *